US011602185B2

(12) United States Patent
White

(10) Patent No.: US 11,602,185 B2
(45) Date of Patent: Mar. 14, 2023

(54) COVER TO PREVENT DAMAGE TO A GARMENT

(71) Applicant: Cindy Berenthal White, Raleigh, NC (US)

(72) Inventor: Cindy Berenthal White, Raleigh, NC (US)

( * ) Notice: Subject to any disclaimer, the term of this patent is extended or adjusted under 35 U.S.C. 154(b) by 23 days.

(21) Appl. No.: 17/196,378

(22) Filed: Mar. 9, 2021

(65) Prior Publication Data

US 2022/0061435 A1 Mar. 3, 2022

Related U.S. Application Data

(60) Provisional application No. 63/072,181, filed on Aug. 30, 2020.

(51) Int. Cl.
*A41D 27/00* (2006.01)
*A41D 27/12* (2006.01)

(52) U.S. Cl.
CPC ..... *A41D 27/12* (2013.01)

(58) Field of Classification Search
CPC .. A41B 1/14; A41B 27/12; A44B 1/14; A44B 5/007; A44B 99/00; G08F 3/02; G08F 3/06; A45C 2001/062; A45C 2001/02; A41F 17/02; A41D 27/12
See application file for complete search history.

(56) References Cited

U.S. PATENT DOCUMENTS 176,292 A * 4/1876 Gardner ..... A41D 1/06 2/232
1,148,934 A * 8/1915 Shuey ..... B42F 1/06 24/563
1,192,101 A * 7/1916 Obsboum ..... A44B 5/00 24/102 FC
1,589,228 A * 6/1926 Robb ..... A41F 15/02 132/278
1,857,488 A * 5/1932 Weeks ..... B42F 1/06 206/39.7
2,535,139 A * 12/1950 Kanarek ..... A44B 5/007 24/41.1
2,577,723 A * 12/1951 Groh ..... A44B 1/14 24/113 MP (Continued)

FOREIGN PATENT DOCUMENTS

WO 2019217862 A1 11/2019

OTHER PUBLICATIONS

Lickety Klip, Inc., "Lickety Klip", Retrieved from the internet: https://www.licketyklip.com [retrieved on Jan. 27, 2021], pp. 1-4.

(Continued)

*Primary Examiner* — Richale L Quinn
(74) *Attorney, Agent, or Firm* — Coats & Bennett, PLLC

(57) ABSTRACT

A cover to attach along an edge of a garment and extend over a fastener. The cover includes front and back members each with outer and inner surfaces. A connector comprising a first end is connected to the front member and a second end is connected to the back member. The connector is sized to space apart the inner surfaces by a gap. The front and back members are connected together in an overlapping arrangement with the inner surfaces facing together and spaced apart on opposing sides of the gap.

18 Claims, 6 Drawing Sheets

(56) References Cited

U.S. PATENT DOCUMENTS 2,585,181 A * 2/1952 Stavropoulos ..... A44B 5/007 24/41.1
3,182,368 A * 5/1965 Fair ..... A44B 9/00 24/3.12
3,484,908 A * 12/1969 Lamb ..... A44B 11/2576 24/579.11
3,561,066 A * 2/1971 Dighton et al. ..... A44B 11/001 40/658
3,934,313 A * 1/1976 Hocq ..... A44B 5/007 24/113 MP
3,947,925 A * 4/1976 Hargrave, Jr. ..... A45C 13/185 24/3.5
4,199,884 A * 4/1980 Loot ..... H01B 7/368 40/316
4,947,524 A * 8/1990 Chang ..... B42F 1/04 24/563
5,621,951 A * 4/1997 Gould ..... A44B 1/14 24/113 MP
5,697,127 A * 12/1997 Tyler ..... A45C 1/06 24/3.12
6,188,881 B1 * 2/2001 Braxton ..... H04B 1/385 340/7.55
6,286,736 B1 * 9/2001 Angus ..... A45F 5/02 224/667
6,842,949 B2 * 1/2005 Warren ..... F16G 11/06 403/371
6,857,167 B2 * 2/2005 Bishop ..... A45F 5/02 24/113 MP
D505,635 S 5/2005 McGee
7,237,306 B1 * 7/2007 Flowers ..... A41F 17/02 24/72.1
7,350,274 B2 * 4/2008 Rogers ..... A44B 1/14 24/113 MP
D581,311 S * 11/2008 Cornett ..... D11/78.1
7,806,069 B2 * 10/2010 Bryant ..... B63B 17/00 114/361
8,726,469 B1 * 5/2014 Delaneau ..... A44B 1/04 24/113 MP
D716,183 S * 10/2014 Crooks ..... D11/215
8,914,949 B2 * 12/2014 Thomson ..... A45C 1/06 24/563
D724,487 S * 3/2015 Dighton ..... D11/222
9,198,480 B1 * 12/2015 Junge ..... A44B 5/007
9,307,806 B1 * 4/2016 Dorman ..... A47G 25/92
9,370,213 B1 * 6/2016 Dighton ..... F16B 2/22
9,498,024 B1 * 11/2016 Jacobsen ..... A44B 1/14
9,993,047 B1 * 6/2018 Patterson ..... A44B 1/14
10,194,717 B2 * 2/2019 Ort ..... A44B 1/04
10,426,248 B2 * 10/2019 Rosenzweig ..... A46B 5/0041
10,555,584 B2 2/2020 Patterson et al.
10,699,603 B2 * 6/2020 Deco ..... G09F 3/06
11,044,969 B2 * 6/2021 Stassinopoulos ..... A44B 1/04
11,166,505 B2 * 11/2021 Gonzalez ..... A41F 5/00
2002/0124356 A1 * 9/2002 O'Mahony ..... A45C 1/06 24/11 R
2003/0101551 A1 * 6/2003 Levesque ..... A44B 99/00 24/545
2006/0249169 A1 * 11/2006 Lee ..... A45F 3/48 132/102
2008/0053473 A1 * 3/2008 Lee ..... A46B 5/0029 132/316
2008/0289159 A1 * 11/2008 Solich ..... D06F 55/00 24/571
2008/0313864 A1 * 12/2008 Suter ..... A44B 1/14 24/113 R
2010/0078101 A1 * 4/2010 Styron ..... A45C 1/06 150/147
2010/0122392 A1 * 5/2010 Clark ..... A44B 6/00 2/243.1
2014/0013551 A1 * 1/2014 Thomson ..... A45C 1/06 24/499
2014/0250640 A1 * 9/2014 Crooks ..... A41F 19/00 24/303
2015/0250269 A1 * 9/2015 Tang ..... A41D 27/08 24/303
2015/0364112 A1 * 12/2015 Kosann ..... A44C 25/004 63/1.11
2016/0338479 A1 * 11/2016 Rosenzweig ..... A46B 9/023
2017/0195000 A1 * 7/2017 Srour ..... H04R 1/1033
2017/0340068 A1 * 11/2017 Ort ..... A44B 1/04

OTHER PUBLICATIONS

Shirt Guardian, "Shirt Guardian", Retrieved from the internet: https://www.shirtguardian.com/ [retrieved on Jan. 27, 2021], pp. 1-9.
Jeanie Clip, "Jeanie Clip", Retrieved from the internet: https://jeanieclip.com [retrieved on Jan. 27, 2021], pp. 1-4.

* cited by examiner

COVER TO PREVENT DAMAGE TO A GARMENT

RELATED APPLICATIONS

This claims priority to U.S. Provisional Application No. 63/072,181, filed Aug. 30, 2020, the disclosure of which is incorporated herein by reference in its entirety.

BACKGROUND

Garments, such as but not limited to pants and skirts, include an overlapping section formed by top and bottom sections. For example, the front of a pair of pants includes opposing sections that are often connected by a zipper. A fastener extends outward from the bottom section at the top edge of the zipper, and an opening is formed in the top section at the top edge of the zipper. When the garment is worn, the zipper closes the front opening and the fastener is inserted into the opening to secure the garment in the closed position.

The garments are usually worn with a top, such as but not limited to a shirt, sweater, and sweatshirt. The top extends over the top edge of the garment and over the fastener. An issue with this design is that one or more of top section and the fastener are exposed and rub against the top and can cause holes or otherwise damage the top.

Various types of fasteners can be used on the garment, such as buttons and rivets. The fasteners can have rough or sharp surfaces that are exposed and contact against the top. When worn for a period of time, these surfaces can cause damage. Additionally, when the garment is worn by the user the overlapping top section of the garment includes corners or edges that protrude outward creating a pointed nub that rubs against and wears the top.

Another issue with this design is that the fastener and/or top section create an unsightly bulge or bulk under the tops. This is visible and provides an undesirable look for the wearer. This is particularly problematic when the top is relatively tight against the garment making the bulge or bulk more noticeable.

Attempts have been made to address this issue. Some devices do not adequately cover the problematic sections leaving one or more of the fastener and second section exposed. Other devices create new friction points that result in the same issues that the devices were meant to correct. Finally, some devices are uncomfortable for the wearer and as a result are not used.

SUMMARY

One aspect is directed to a cover to attach along an edge of a garment and extend over a fastener. The cover comprises front and back members each comprising an outer domed surface and an opposing concave inner surface. A connector comprising a first end is connected to the front member and a second end is connected to the back member. The connector is sized to space apart the inner surfaces by a gap. The front and back members are connected together in an overlapping arrangement with the inner surfaces facing together and spaced apart on opposing sides of the gap.

In another aspect, the connector is connected to a top section of a perimeter edge of each of the front and back members.

In another aspect, the top section of the perimeter edge of each of the front and back members is flat and a remainder of the perimeter edge of each of the front and back members is rounded.

In another aspect, the front member is smaller than the back member and with the top section of each of the front and back members aligned together and with a remainder of the perimeter edge of the back member extending outward beyond the front member.

In another aspect, each of the front and back members comprises an identical shape.

In another aspect, the front and back members and the connector are constructed as a unitary one-piece construction.

In another aspect, the front member and the back member are aligned at an acute angle.

One aspect is directed to a cover to attach along an edge of a garment and extend over a fastener. The cover comprises a front member configured to be positioned on a front side of the garment and a back member configured to be positioned on an inner side of the garment. A connector is connected to a top section of perimeter edges of each of the front and back members to connect the front and back members together. The perimeter edge of the front member is positioned within a first plane and the perimeter edge of the back member is positioned within a second plane with the first and second planes aligned at an acute angle.

In another aspect, the acute angle is less than 10°.

In another aspect, the acute angle is 7°.

In another aspect, each of the front and back members comprise a domed outer surface that face outward away from the garment when the cover is attached to the garment.

In another aspect, each of the front and back members comprise a concave inner surface that face inward towards the garment when the cover is attached to the garment.

In another aspect, the front and back members and the connector comprise a unitary one-piece construction.

In another aspect, the front member is smaller than the back member and positioned within a footprint of the back member.

One aspect is directed to a cover to attach along an edge of a garment and extend over a fastener. The cover comprises front and back members each comprising an outer domed surface, an opposing concave inner surface, and a perimeter edge positioned between the inner and outer surfaces. A connector connects to a top section of the perimeter edges of the front and back members. The connector extends between and connects the front and back members together and spaces apart the front and back members by a gap. The front and back members are connected together in an overlapping arrangement with the inner surfaces facing together and spaced apart on opposing sides of the gap. The perimeter edge of the front member is positioned within a first plane and the perimeter edge of the back member positioned within a second plane. The front and back members are connected together with the first and second planes aligned at an acute angle.

In another aspect, the back member is larger than the front member and extends outward beyond the front member along lateral and bottom sections of the perimeter edge of the front member.

In another aspect, the front and back members and separate pieces that are connected together by the connector.

In another aspect, the acute angle is less than 10°.

In another aspect, the front and back members comprise identical shapes.

In another aspect, the connector comprises a tapered shape to position the front and back members at the acute angle.

The features, functions and advantages that have been discussed can be achieved independently in various aspects or may be combined in yet other aspects, further details of which can be seen with reference to the following description and the drawings.

DETAILED DESCRIPTION

Figure 1:
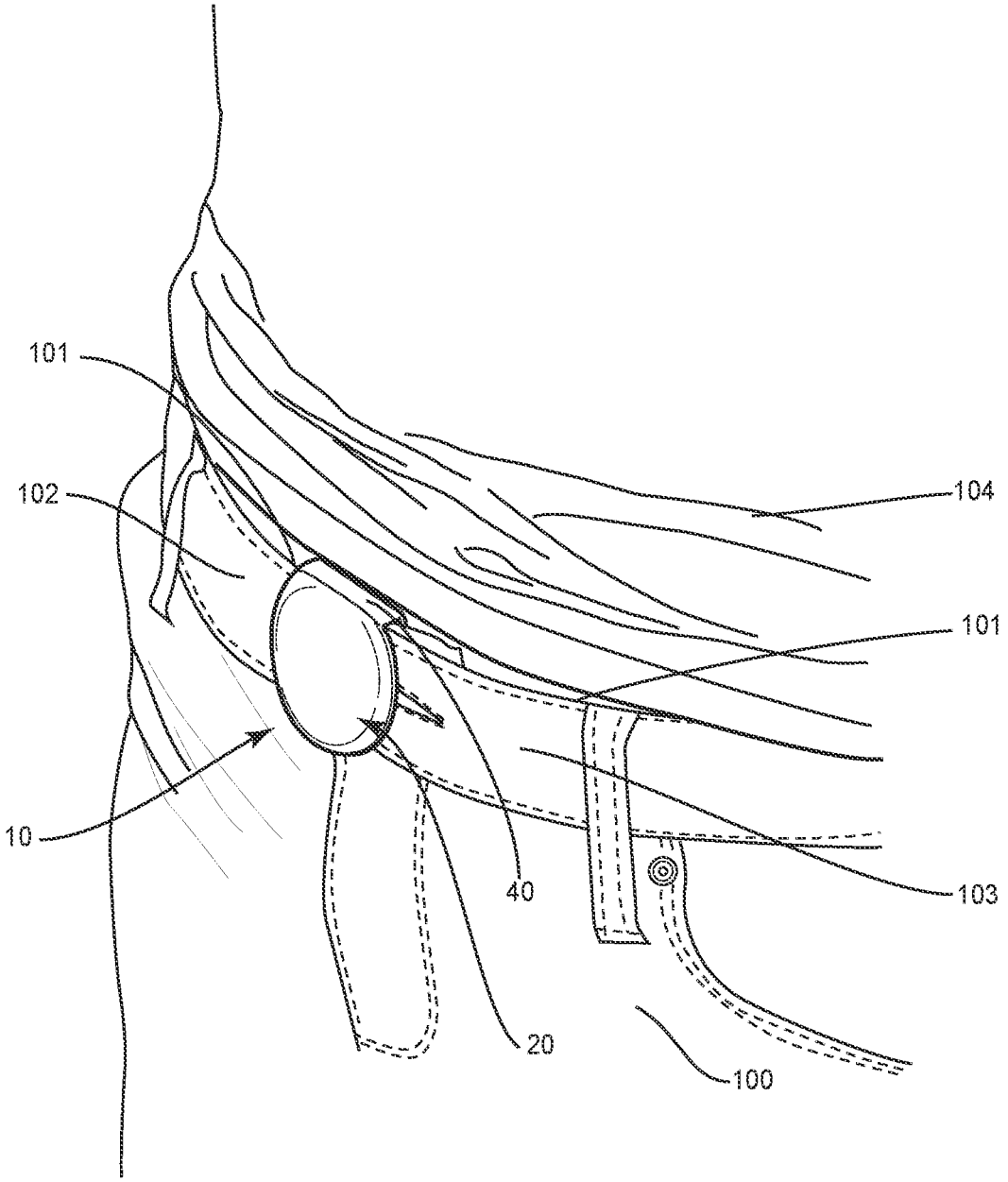
FIG. 1 is a perspective view of a cover attached to a garment.

FIG. 1 illustrates a cover 10 attached to an upper edge 101 of a garment 100. The cover 10 includes a front member 20 that extends over a fastener (not illustrated in FIG. 1) that is attached to and extends outward from a first section 102 of the garment 100. The fastener extends through an opening in an upper second section 103. The cover 10 includes the front member 20 that extends over an outer edge of the garment 100, a back member (not illustrated in FIG. 1) that is positioned on the inner side of the garment 100, and a connector 40 that connects together the front member 20 and the back member. The connector 40 is positioned along an upper edge 101 of the garment 100. The cover 10 extends over the fastener and edges of the second section 103. The cover 20 prevents the fastener and/or edges from causing damage to a top 104 when the top 104 is pulled over the garment 100. The cover 10 also prevents the fastener and/or edges from creating one or more bulges in the top 104 that are aesthetically unattractive.

Figure 2:
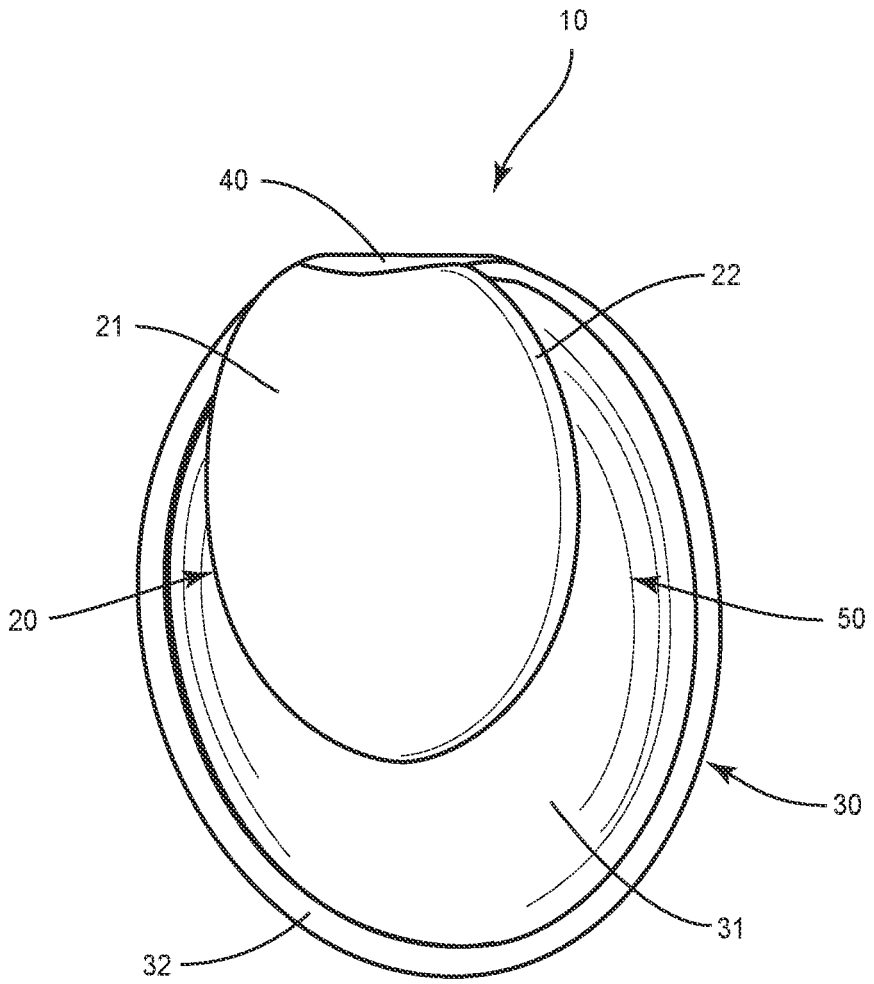
FIG. 2 is a perspective view of a cover.

FIG. 2 illustrates a cover 10 that includes a front member 20, a back member 30, and a connector 40. The connector 40 connects the front and back members 20, 30 together in an overlapping arrangement. In this example, the front and back members 20, 30 are attached together along a section of the perimeter edges 22, 32. The front member 20 is smaller than the back member 30 and is aligned within the footprint of the back member 30. The one section of the front and back members 20, 30 is aligned, and the perimeter edge 32 of the back member 30 extends outward beyond the perimeter edge 22 along a remainder of the front member 20.

Both of the front and back members 20, 30 respectively include a body 21, 31 with an outer perimeter edge 22, 32. The front and back members 20, 30 can include a variety of different shapes, with one example having a rounded shape as illustrated in FIGS. 1 and 2. Other shapes include but are not limited to circular, oval, rectangular, and polygonal. In one example, the shapes include rounded edges to prevent creating a sharp edge that could catch and potentially damage the top 104 of the garment 100.

Figure 3:
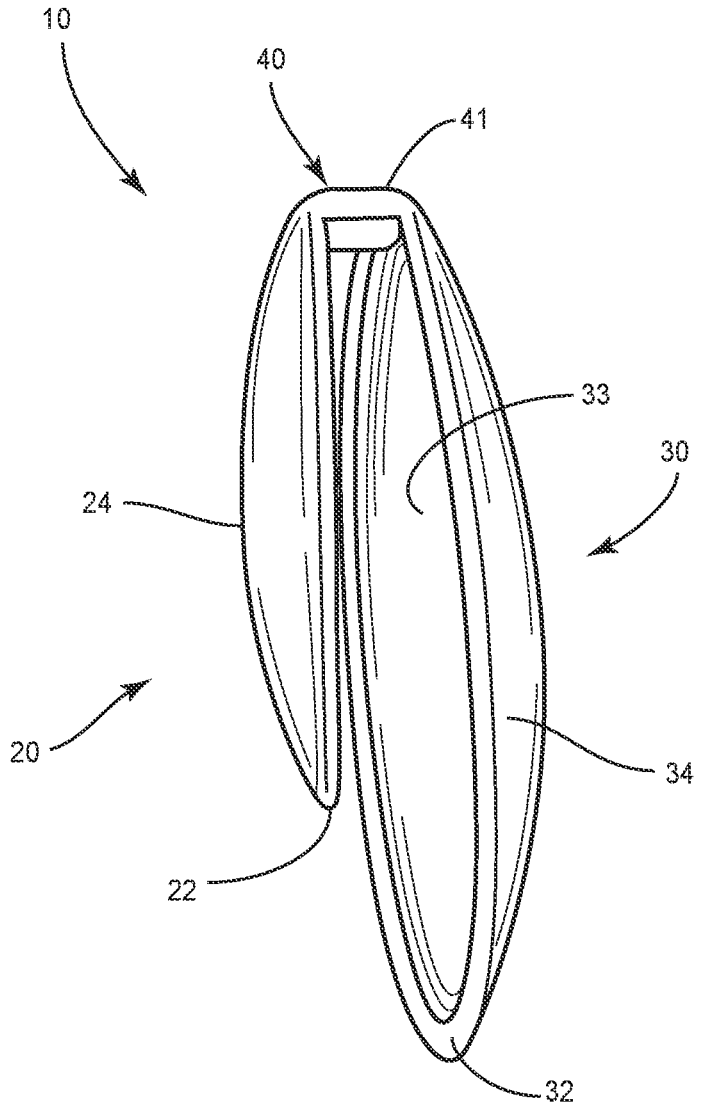
FIG. 3 is a perspective view of a cover.
Figure 4:
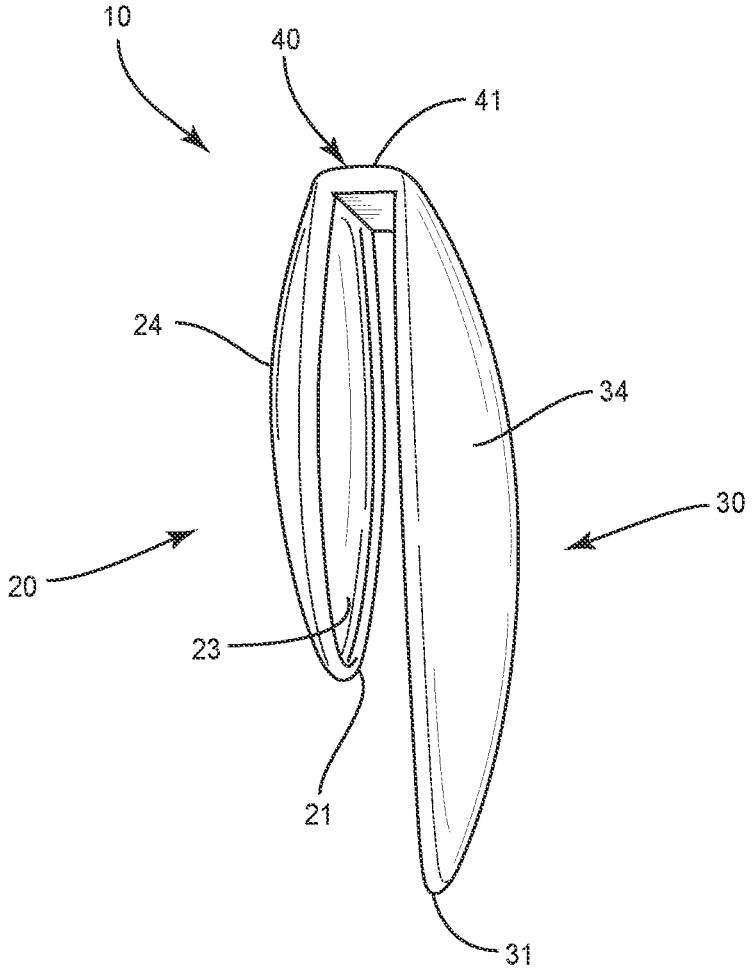
FIG. 4 is a perspective view of a cover.

As illustrated in FIGS. 3 and 4, each of the front and back members 20, 30 include an inner surface 23, 33 and an outer surface 24, 34. The outer perimeter edges 22, 33 respectively extend along and divide the inner and outer surfaces 23, 24, 33, 34.

Figure 5:
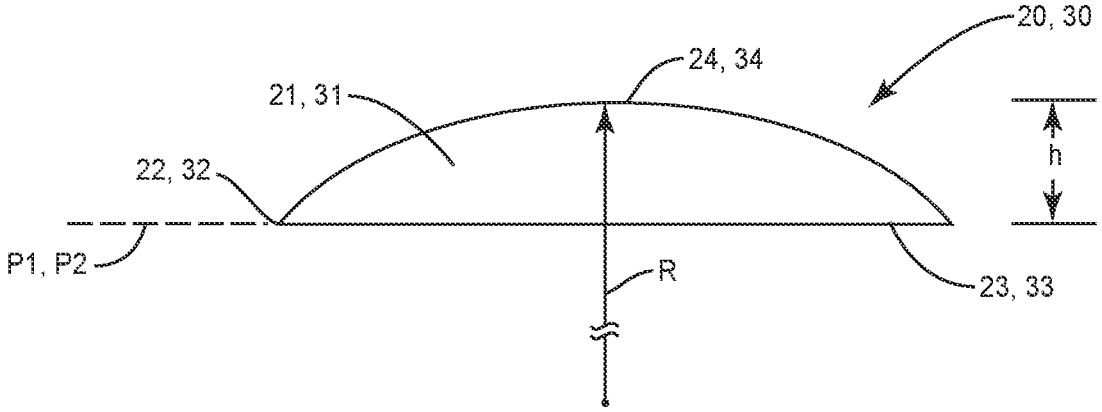
FIG. 5 is a schematic side view of a front member or a back member.

In one example, one or both of the front and back members 20, 30 includes a domed shape. As illustrated in FIG. 5, the domed shape includes a height h measured between the inner and outer surfaces 23, 24, 33, 34. The domed shape includes a curved outer surface 24, 34. As illustrated in FIG. 5, the curved shape of the outer surface 24, 34 can be consistent and include a radius R that extends across the entirety of the outer surface 24, 34. In another example, the curvature varies across the outer surface 24, 34. In one example, one or both of the outer surfaces 24, 34 include one or more sections that are flat and one or more sections that have a rounded shape. In another example, one or outer surfaces 24, 34 do not include a domed shape.

As illustrated in FIGS. 3 and 4, the inner surfaces 23, 33 of one or both of the front and back members 20, 30 can be concave. The curvature of the surfaces 23, 33 can be constant throughout the member 20, 30 with a constant radius R, or include different curvatures along different sections. In another example, one or both of the inner surfaces 23, 33 are flat. The concave shape of the inner surface 23 provides for receiving a first end of the fastener on the garment 100. The concave shape of the inner surface 33 provides for receive a second end of the garment 100.

In one example as illustrated in FIG. 5, the perimeter edges 22, 32 of one or both of the front and back members 20, 30 are aligned in a plane P1, P2. Edges 22 of the front member 20 are aligned in a plane P1 and the edges 32 of the back member 30 are aligned in a plane P2.

In one example, the inner surfaces 23, 33 of one or both of the members 20, 30 is flat. This provides for the inner surfaces 23, 33 to be aligned in the plane P1, P2 respectively.

In one example, the outer surfaces 24, 43 of the one or both of the front and back members 20, 30 is smooth. The smooth outer surface 24 reduces friction that could occur between the cover 10 and the garment 100 and/or top 104. The smooth outer surface 34 provides a comfortable feel for the wearer.

In one example, the inner surfaces 23, 33 of one or both of the front and back members 20, 30 is smooth. One or both smooth surfaces 23, 33 enables a more straight-forward attachment of the cover 10 over the edge of the garment 100.

The connector 40 connects the front member 20 and the back member 30 together. The connector 40 is connected to and extends outward from the outer edge 22 of the front member 20 and the outer edge 32 of the back member 30. The connector 40 can include a first end that connects to the front member 20 and an opposing second end that connects to the back member 30.

As illustrated in FIGS. 3 and 4, the connector 40 includes an outer edge 41. In one example, the outer edge 41 is substantially flat to align with the upper edge 101 of the garment 100. In another example, the edge 41 includes a rounded shape to match the shape of one or both of the front and back members 20, 30. The connector 40 extends along limited sections of the perimeter edges 22, 32.

Figure 6:
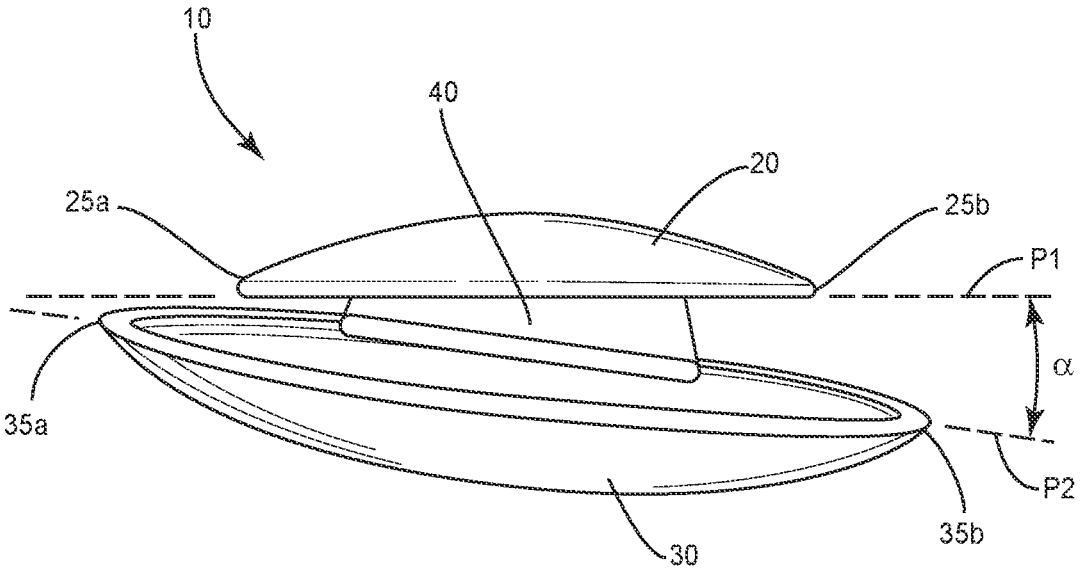
FIG. 6 is a perspective view of a cover.

The connector 40 is sized to space apart the inner surfaces 23, 33 of the front and back members 20, 30. In one example, the connector 40 spaces the front and back members 20, 30 an equal distance apart with the planes P1, P2 formed by the outer perimeter edges 22, 32 being substantially parallel. In another example as illustrated in FIG. 6, the connector 40 spaces the front and back members 20, 30 at a non-parallel angle $\alpha$. The angle $\alpha$ is formed by the planes P1 and P2. In one example, the angle $\alpha$ is an acute angle. In another example, the angle $\alpha$ is less than 10°. In another example, the angle $\alpha$ is 7°. This angled configuration provides for the cover 10 to be positioned along the top edge 101 of the garment 101 with a first lateral side with the smaller angle overlapping just the bottom section 102 of the garment 100, and the second lateral side with the larger angle positioned where the bottom and top sections 102, 103 overlap as illustrated in FIG. 1.

The connector 40 is flexible to provide for separating the front and back members 20, 30. This facilitates attachment to the garment 100 and provides for the cover 10 to attach to garments 100 of varying thicknesses. The connector 40 can also be expanded to separate the front and back members 20, 30 and then return together to apply a clamping force to maintain the position of the cover 10 on the garment 100. In one example, the connector 40 includes a biasing member such as a spring to provide for the front and back members 20, 30 to be separated and then return towards their original position.

In one example, the connector 40 is configured to hold the front and back sections 20, 30 a fixed distance apart. The user is able to apply a force to separate the front and back sections 20, 30 as necessary during use. In one example, the cover 10 is constructed as a unitary, one piece member with each of the front member 20, back member 30, and connector 40 constructed as a single piece of the same material. In another example, the connector 40 and front and back members 20, 30 are each separate components that are connected together by the connector 40. The connector 40 can be connected in various manners, such as but not limited to adhesives and mechanical fasteners.

In one example, the cover 10 is constructed using a 3D printing method. In another example, the cover 10 is constructed in an injection molding process. In the various methods, the cover 20 can be constructed as a single, unitary piece, or constructed from two or more separate parts that are subsequently connected together.

The connector 40 can include a tapered shape to position the front and back members 20, 30 at the angle $\alpha$. One side of the connector 40 can be shorter than the opposing second side to position the front and back members 20, 30.

FIGS. 3 and 4 illustrate one example of a cover 10. Each of the front and back members 20, 30 include the same rounded shape. The back member 20 is larger than the front member 20. The top edges of the front and back members 20, 30 are aligned and connected by the connector 40. The back member 30 extends outward beyond the perimeter edge 22 of the front member 20 along the other sections.

In this example, each of the front and back members 20, 30 include a domed outer surface 24, 34. The domed outer surface 24 of the front member 20 helps to prevent the cover from catching on the top 104. Additionally or alternatively, the domed shape also better hides the cover 10 when positioned under the top 104. The domed outer surface 34 provides a more comfortable fit for the wearer as the outer surface 34 faces towards and can contact against the wearer and/or be felt by the wearer.

The inner surface 23 of the front member 20 is concave. This shape provides for the front member 20 to fit over the fastener of the garment 100. The head of the fastener fits within the recess and provides for the outer edges 22 to contact against the garment 100 thus decreasing the overall size and appearance of the cover 10. The inner surface 33 of the back member 30 is also concave. This shape provides for the back member 30 to extend over and receive the inner end of the fastener on the garment 100. In one example, the concave shape of the front member 20 has a depth of 7.5 mm and the concave shape of the back member 30 has a depth of 10 mm.

In this example, the front and back members 20, 30 are aligned at an angle $\alpha$ of 7°. The space at the first lateral side 25*a* is 4 mm and the space at the second lateral side 25*b* is 8 mm. The front member 20 has a length of 43 mm measured between the lateral sides 25*a*, 25*b*. The back member 30 has a length of 65 mm measured between the lateral sides 35*a*, 35*b*.

In one example, the front member 20 includes a relatively constant thickness with the inner and outer surfaces 23, 24 having corresponding curvatures. In another example, the back member 30 includes a relatively constant thickness with the inner and outer surfaces 33, 34 having corresponding curvatures.

The cover 10 can be constructed from a variety of different materials. Examples include but are not limited to plastics, and metal.

In one example, the cover 10 is sized and shaped to extend over a single connector on the garment 100. For example, to extend over a single rivet on a pair of jeans. In another example, the cover 10 is sized to extend over multiple connectors on the garment 100.

The cover 10 can include one or more magnets on one or both of the front and back members 20, 30. The one or more magnets can be magnetically attracted to the connector on the garment 100 to further connect the cover 10 to the garment 100.

The cover 10 can include a clip on one or both of the front and back members 20, 30. The clip engages with the garment 100 to further attach the cover 100. The clip can be configured to connect to the fastener on the garment 10 and/or one or both of the first and second sections 102, 103.

During use, the wearer installs the cover 10 after the garment 100 is on the wearer and the first and second sections 102, 103 are fastened together. To install the cover 10, the user places one or two fingertips under the lower edge of the front member 20 and places their thumb on the connector 40. With their other hand, the user pulls the front of the garment 100 away from their skin. The user then slides the cover 10 downward with the back member 30 against the back of the garment 100 and the front member 20 against the front of the garment 100. The cover 10 sandwiches the garment 100 with the concave inner surfaces 23, 33 aligned with the opposing ends of the garment fastener. While sliding the cover 10 downward, the user pulls out the bottom of the front member 20 with their fingertips so that it clears any fasteners or fabric bulges thereby sandwiching this area between the front and back members 20, 30. The user slides the cover 10 downward until connector 40 is in direct contact with the upper edge 101 of the garment 100. The user can then adjust the cover 10 relative to the garment 100 as needed to make sure the cover 10 is centered over fastener area.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

The invention claimed is:

1. A cover to attach along an edge of a garment and extend over a fastener, the cover comprising:

front and back members each comprising an outer domed surface and an opposing concave inner surface;

a connector comprising a first end connected to the front member and a second end connected to the back member, the connector sized to space apart the inner surfaces by a gap;

the front and back members connected together in an overlapping arrangement with the inner surfaces facing together and spaced apart on opposing sides of the gap; and the connector comprises a tapered shape along a length of the connector with a width at a first end being smaller than a width at a second end to position the front member and the back member at a non-parallel angle.

2. The cover of claim 1, wherein the connector is connected along a flat top section a perimeter edge of each of the front and back members and a remainder of the perimeter edge of each of the front and back members is circular.

3. The cover of claim 1, wherein a top section of a perimeter edge of each of the front and back members is flat and a remainder of the perimeter edge of each of the front and back members is continuously rounded.

4. The cover of claim 2, wherein the front member is smaller than the back member and with the top section of each of the front and back members aligned together and with a remainder of the perimeter edge of the back member extending outward beyond the front member.

5. The cover of claim 1, wherein the front member and the back member are aligned at an acute angle.

6. A cover to attach along an edge of a garment and extend over a fastener, the cover comprising:

a front member configured to be positioned on a front side of the garment;

a back member configured to be positioned on an inner side of the garment;

a connector connected to a top section of perimeter edges of each of the front and back members to connect the front and back members together, the connector comprising a first end and an opposing second end;

wherein the perimeter edge of the front member is positioned within a first plane and the perimeter edge of the back member is positioned within a second plane with the first and second planes aligned at an acute angle with a distance between the front and back members being smaller at the first end of the connector and larger at the second end of the connector.

7. The cover of claim 6, wherein the acute angle is less than 10°.

8. The cover of claim 7, wherein the acute angle is 7°.

9. The cover of claim 6, wherein each of the front and back members comprise a domed outer surface that face outward away from the garment when the cover is attached to the garment.

10. The cover of claim 9, wherein each of the front and back members comprise a concave inner surface that face inward towards the garment when the cover is attached to the garment.

11. The cover of claim 6, wherein the front member is smaller than the back member and positioned within a footprint of the back member with the larger back member configured to contact against a wearer when the cover is attached to the garment.

12. A cover to attach along an edge of a garment and extend over a fastener, the cover comprising:

front and back members each comprising an outer domed surface, an opposing concave inner surface, and a perimeter edge positioned between the inner and outer surfaces; and a connector connected to a top section of the perimeter edges of the front and back members with the connector comprising a length measured between a first end and a second end, the connector extends between and connects the front and back members together and spaces apart the front and back members by a gap;

the front and back members connected together in an overlapping arrangement with the inner surfaces facing together and spaced apart on opposing sides of the gap; and the perimeter edge of the front member positioned within a first plane and the perimeter edge of the back member positioned within a second plane, the connector comprising a tapered shape along the length to position the front and back members together with the first and second planes aligned at an acute angle.

13. The cover of claim 12, wherein the back member is larger than the front member and extends outward beyond the front member along lateral and bottom sections of the perimeter edge of the front member.

14. The cover of claim 12, wherein the front and back members are separate pieces that are connected together by the connector.

15. The cover of claim 12, wherein the acute angle is less than 10°.

16. The cover of claim 1, wherein the outer domed surfaces face outward when the cover is attached to the garment.

17. The cover of claim 1, wherein the outer domed surfaces of the front and back members include a constant radius.

18. The cover of claim 1, wherein each of the front and back members comprise a height measured between a perimeter edge and a top of the outer domed surface.

* * * * *